US010431179B2

(12) United States Patent
Hao

(10) Patent No.: US 10,431,179 B2
(45) Date of Patent: Oct. 1, 2019

(54) DEMUX CIRCUIT

(71) Applicant: Shenzhen China Star Optoelectronics Technology Co., Ltd., Shenzhen (CN)

(72) Inventor: Sikun Hao, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 136 days.

(21) Appl. No.: 15/540,028

(22) PCT Filed: May 18, 2017

(86) PCT No.: PCT/CN2017/084955

§ 371 (c)(1),
(2) Date: Jun. 27, 2017

(87) PCT Pub. No.: WO2018/192049

PCT Pub. Date: Oct. 25, 2018

(65) Prior Publication Data

US 2018/0301104 A1 Oct. 18, 2018

(30) Foreign Application Priority Data

Apr. 17, 2017 (CN) ..... 2017 1 0250566

(51) Int. Cl.
*G09G 3/36* (2006.01)

(52) U.S. Cl.
CPC ... *G09G 3/3685* (2013.01); *G09G 2300/0417* (2013.01); *G09G 2310/0251* (2013.01); *G09G 2310/0297* (2013.01); *G09G 2330/04* (2013.01)

(58) Field of Classification Search
None
See application file for complete search history.

(56) References Cited

U.S. PATENT DOCUMENTS

2005/0243043 A1 11/2005 Jeoung et al.
2016/0329025 A1* 11/2016 Park ..... G09G 3/3688

FOREIGN PATENT DOCUMENTS

CN 1952765 A 4/2007
CN 106469547 A 3/2017
CN 107016970 A 8/2017

* cited by examiner

*Primary Examiner* — Andre L Matthews
(74) *Attorney, Agent, or Firm* — Leong C. Lei

(57) ABSTRACT

The invention provides a DEMUX circuit, comprising: data bus, a first, second and third data lines, connected respectively to data bus and a first unit, a second unit and a third unit respectively; each unit respectively comprising: a TFT, a second TFT, a third TFT, and a capacitor, and inputting corresponding a first, a second, and a third switch signals; for each unit, during operation, when the first switch signal being turned on, the first TFT and the second TFT being turned on, and the corresponding data line is pre-charged; when the first switch signal being turned off, the second switch signal being turned on and the corresponding data line being charged to a preset voltage. The DEMUX circuit of the invention can increase the TFT gate driving voltage, leading to improving TFT electron mobility from IGZO and a-Si process, and improving the data line charging rate.

11 Claims, 5 Drawing Sheets

DEMUX CIRCUIT

BACKGROUND OF THE INVENTION

1. Field of the Invention

The present invention relates to the field of display, and in particular to a DEMUX circuit.

2. The Related Arts

The liquid crystal display (LCD) is the most widely used panel display, and has become the choice of high resolution color screen display for various electronic products, such as, mobile phones, Personal digital assistant (PDAs), digital cameras, computer monitor or notebook computer screen. As the LCD technology progresses, the demands on the display quality and external appearances of the LCD also get higher, and the objectives is to further lower cost and narrow border designs.

The demultiplexer (DEMUX) is used for de-composing a signal channel into a plurality of signal channels, and is widely used in small-to medium size LCD. In LCD, DEMUX is usually with low temperature polysilicon (LTPS) process, the thin film transistor (TFT) manufactured by LTPS process usually has high electron mobility satisfying the needs of DEMUX.

As the LCD technology moves towards low cost, IGZO process and amorphous silicon (a-Si) process also have a demand for DEMUX. However, because the elements manufactured by the IGZO process and a-Si process has electron mobility much lower than the LTPS process, the charging rate of the panel is affected after using DEMUX.

FIG. 1 shows a known LCD driving structure. The pixel array is surrounded with various wires and circuits, including: flexible printed circuit pad (FPC pad), IC pad, wire on array (WOA), fan-out, DEMUX, electrostatic discharge (ESD) SR (trigger), gate driver on array (GOA), common bus/ESD (Com Bus/ESD). The present invention is related to the DEMUX shown in FIG. 1.

FIG. 2 shows the known DEMUX circuit used in LCD. The DEMUX circuit comprises three thin film transistors (TFT), and the gates of the three TFTs are respectively inputted with signals SW1, SW2 and SW3, the sources/drains are respectively connected to Data Bus N, and the drains/sources are connected respectively to Data line 3N, 3N+1 and 3N+2. The signals SW1, SW2 and SW3 control the ON and OFF of the individual TFT according to the preset timing. When the TFT is turned on, the Data Bus N can be connected with the corresponding Data Line to charge the Data Line. This kind of DEMUX circuit is usually with LTPS process, because the LTPS process has higher electron mobility, the use of the DEMUX circuit can still maintain a relatively high Data Line charging rate. As the LCD technology moves towards low cost, IGZO process and amorphous silicon (a-Si) process also have a demand for DEMUX. However, because the elements manufactured by the IGZO process and a-Si process has electron mobility much lower than the LTPS process, the charging rate of the panel is affected after using DEMUX.

SUMMARY OF THE INVENTION

The object of the present invention is to provide a DEMUX circuit, improving the DEMUX charging rate for a-Si process.

To achieve the above object, the present invention provides a DEMUX circuit, comprising:

a data bus, a first data line, a second data line and a third data line, connected respectively to the data bus and a first unit, a second unit and a third unit respectively corresponding to the first, second and third data lines;

each unit respectively comprising: a first thin film transistor (TFT), a second TFT, a third TFT, and a capacitor, and inputting corresponding a first, a second, and a third switch signals; the first TFT having a gate inputting the first switch signal, and a source and a drain irrespectively inputting to the first switch signal and connected to a gate of the second TFT; the second TFT having a source and a drain respectively connected to the data bus and the corresponding data line; the capacitor having one end connected to the gate of the second TFT and the other connected to the second switch signal; the third TFT having a gate inputting the third switch signal, a source and a drain respectively connected to the gate of the second TFT and a constant low voltage;

for each unit, during operation, when the first switch signal being turned on, the first TFT and the second TFT being turned on, and the corresponding data line is pre-charged; when the first switch signal being turned off, the second switch signal being turned on and the corresponding data line being charged to a preset voltage.

According to a preferred embodiment of the present invention, four switch signals are used for inputting to the first, second and third units, each unit selects three switch signals out of the four to use as the first, second and third switch signals corresponding to the unit.

According to a preferred embodiment of the present invention, the four switch signals are square waveform having a duty cycle of 0.25, with a phase difference of ¼ cycle among one another.

According to a preferred embodiment of the present invention, during operation, by controlling timing of the switch signals corresponding to each unit, when the first unit charges the first data line to a preset voltage, the second unit simultaneously pre-charges the second data line; when the second unit charges the second data line to a preset voltage, the third unit simultaneously pre-charges the third data line; when the third unit charges the third data line to a preset voltage, the first unit simultaneously pre-charges the first data line.

According to a preferred embodiment of the present invention, the DEMUX circuit is for indium gallium zinc oxide (IGZO) process.

According to a preferred embodiment of the present invention, the DEMUX circuit is for amorphous silicon (a-Si) process.

According to a preferred embodiment of the present invention, the DEMUX circuit is connected to an RGB display panel for outputting RGB data signals.

According to a preferred embodiment of the present invention, the data bus uses every four periods as a cycle, and stays vacant for a period after continuously outputs RGB data signals.

The present invention also provides a DEMUX circuit, comprising:

a data bus, a first data line, a second data line and a third data line, connected respectively to the data bus and a first unit, a second unit and a third unit respectively corresponding to the first, second and third data lines;

each unit respectively comprising: a first thin film transistor (TFT), a second TFT, a third TFT, and a capacitor, and inputting corresponding a first, a second, and a third switch signals; the first TFT having a gate inputting the first switch signal, and a source and a drain irrespectively inputting to the first switch signal and connected to a gate of the second TFT; the second TFT having a source and a drain respectively connected to the data bus and the corresponding data line; the capacitor having one end connected to the gate of the second TFT and the other connected to the second switch signal; the third TFT having a gate inputting the third switch signal, a source and a drain respectively connected to the gate of the second TFT and a constant low voltage;

for each unit, during operation, when the first switch signal being turned on, the first TFT and the second TFT being turned on, and the corresponding data line is pre-charged; when the first switch signal being turned off, the second switch signal being turned on and the corresponding data line being charged to a preset voltage;

wherein four switch signals being used for inputting to the first, second and third units, each unit selecting three switch signals out of the four to use as the first, second and third switch signals corresponding to the unit;

wherein the DEMUX circuit being connected to an RGB display panel for outputting RGB data signals.

In summary, the DEMUX circuit of the present invention can increase the driving voltage of the TFT gate, leading to improving the TFT electron mobility from IGZO process and a-Si process, and improving the data line charging rate.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
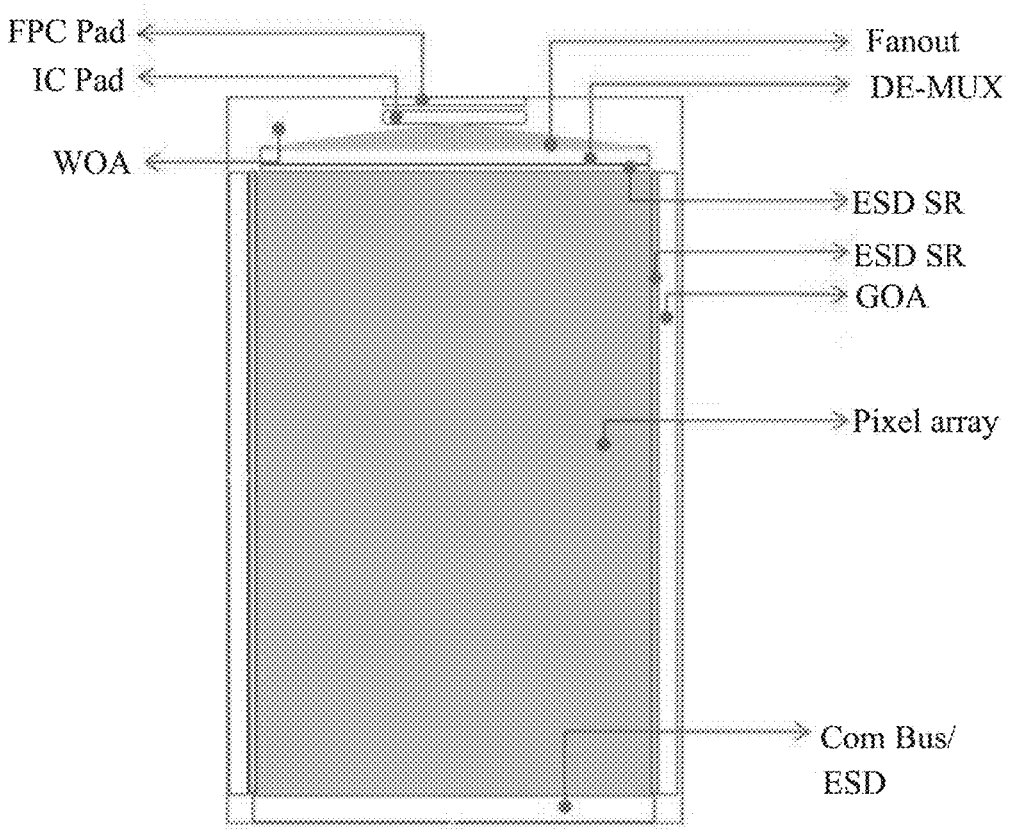
Fig. 1 Prior Art
FIG. 1 is a schematic view showing a driving structure in known LCD.
Figure 2:
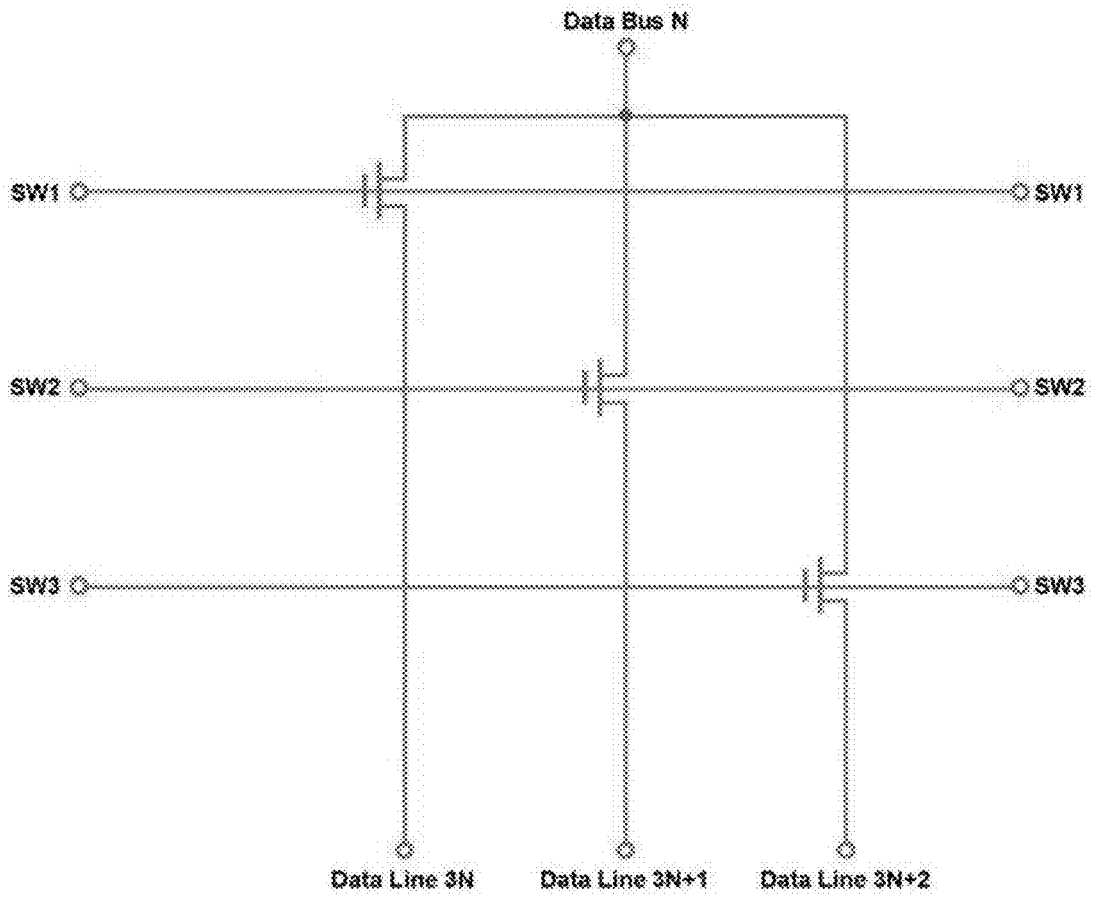
Fig. 2 Prior Art
FIG. 2 is a schematic view showing the DEMUX circuit in known LCD.
Figure 3:
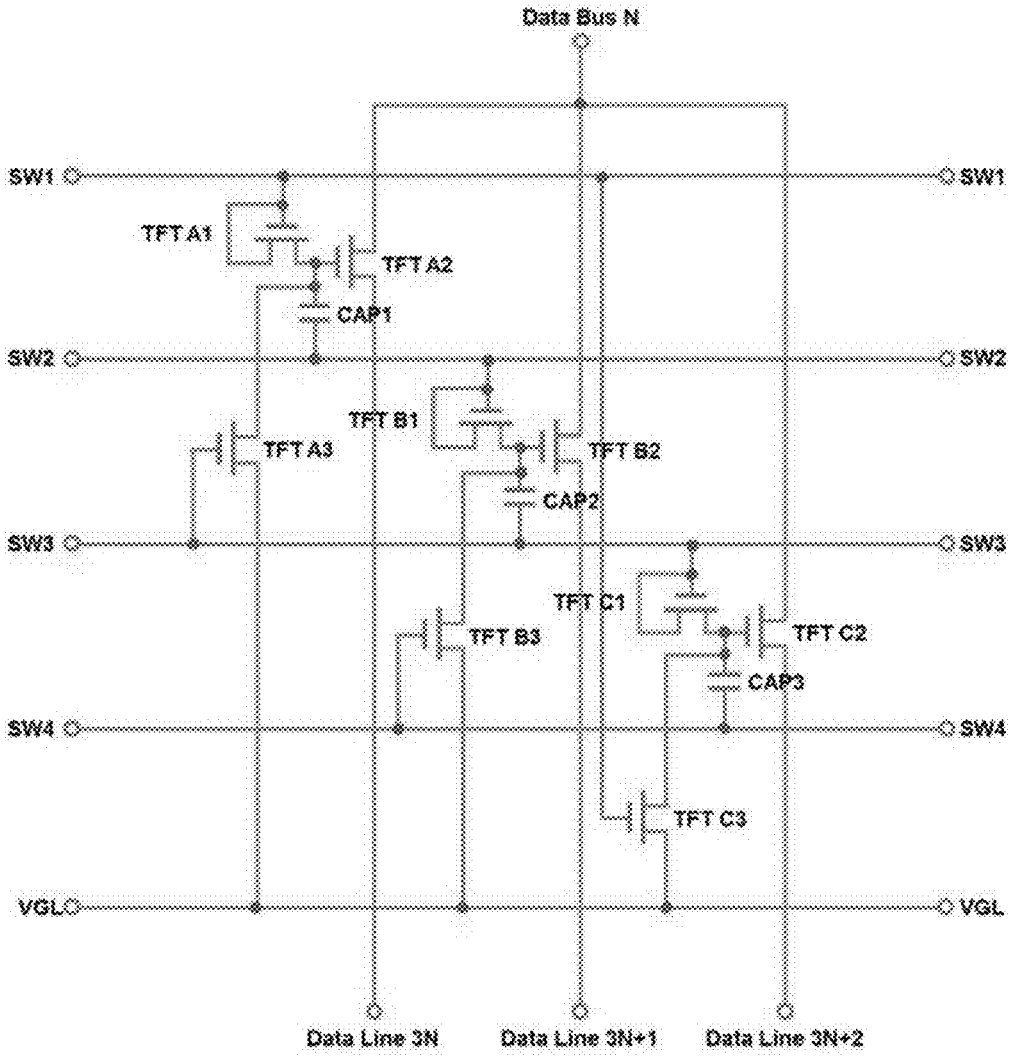
FIG. 3 is a schematic view showing the DEMUX circuit according to the present invention.

FIG. 3 is a schematic view showing the DEMUX circuit according to the present invention. The DEMUX circuit comprises: a data bus N, a first data line 3N, a second data line 3N+1, and a third data line 3N+2, connected respectively to the data bus N and a first unit, a second unit and a third unit respectively corresponding to the first, second and third data lines.

The first unit comprises: a first thin film transistor (TFT) A1, a second TFT A2, a third TFT A3, and a capacitor CAP1; the second unit comprises: a first TFT B1, a second TFT B2, a third TFT B3, and a capacitor CAP2; the third unit comprises: a first TFT C1, a second TFT C2, a third TFT C3, and a capacitor CAP3.

The following uses the first unit as an example to describe the structure and function of each unit. In the first unit:

the first TFT A1 having a gate inputting the first switch signal SW1, and a source and a drain irrespectively inputting to the first switch signal SW1 and connected to a gate of the second TFT A2;

the second TFT A2 having a source and a drain respectively connected to the data bus N and the corresponding data line 3N;

the capacitor CAP1 having one end connected to the gate of the second TFT A2 and the other connected to the second switch signal SW2;

the third TFT A3 having a gate inputting the third switch signal SW3, a source and a drain respectively connected to the gate of the second TFT A2 and a constant low voltage VGL;

for the first unit, during operation, when the first switch signal SW1 being turned on, the first TFT A1 and the second TFT A2 being turned on, and the corresponding data line 3N is pre-charged; when the first switch signal SW1 being turned off, the second switch signal SW2 being turned on and the corresponding data line 3N being charged to a preset voltage.

For other units, during operation, when the first switch signal is turned on, the first TFT and the second TFT are turned on, and the corresponding data line is pre-charged; then, when the first switch signal is turned off, the second switch signal is turned on and the corresponding data line is charged to a preset voltage. The switch signals of the other units are different from the switch signals of the first unit.

Moreover, the constant low voltage VGL can be used for discharge recovery for each capacitor. For example, for the first unit, when the switch signal SW2 is turned off, the switch signal SW3 is turned on, the capacitor CAP1 can achieve discharge recovery through the constant low voltage.

Furthermore, the present invention can control the operation of the first, second and third units by providing switch signals SW1, SW2, SW3, and SW4 and disposing appropriate timing. Each unit selects three appropriate switch signals out of the four switch signals to use as the first, second, and third switch signals corresponding to the unit. The four switch signals are square waveform having a duty cycle of 0.25, with a phase difference of ¼ cycle among one another (see FIG. 4).

Figure 4:
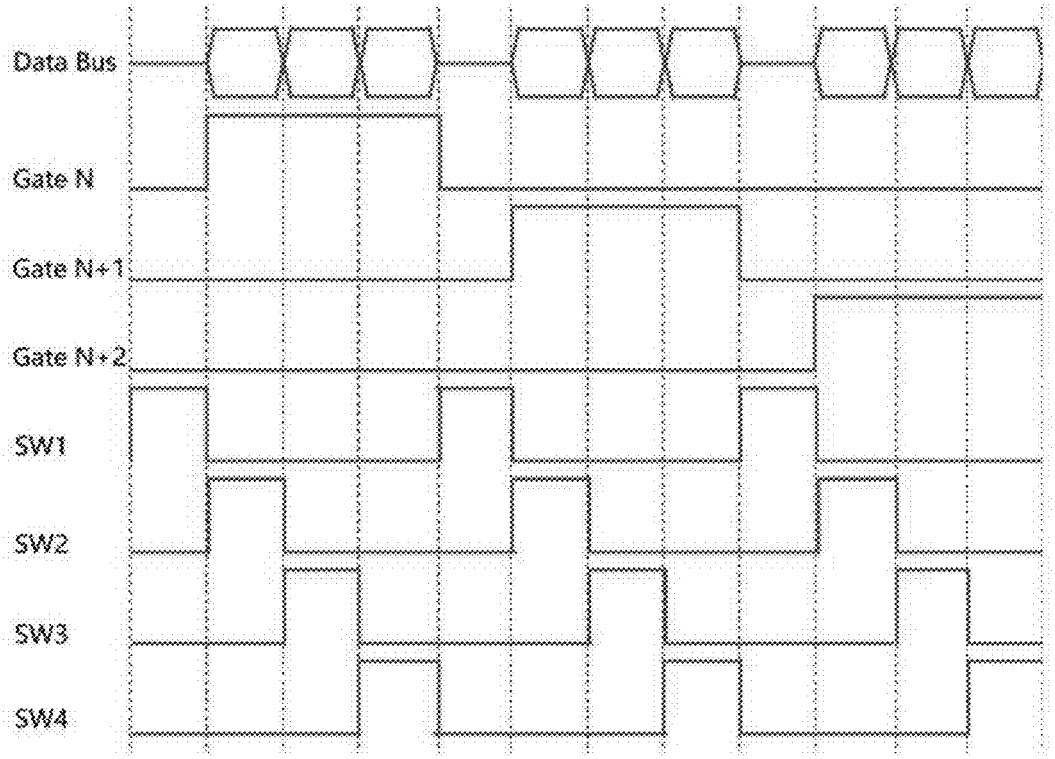
FIG. 4 is a schematic view showing the timing of the DEMUX circuit according to the present invention.

FIG. 4 shows the timing of the DEMUX circuit of the present invention. Refer to FIG. 3 and FIG. 4 for the operation principle of the DEMUX circuit of the present invention. When SW1 is turned on, TFT A1 and TFT A2 are turned on, and Data line 3N is pre-charged; then SW1 is off and SW2 is on, through the coupling effect of the capacitor CAP1, the gate voltage of TFT A2 is further raised and data line 3N is charged to a preset voltage, and the data line 3N+1 is pre-charged simultaneously; then, n, TFT A1 and TFT A2 are turned on, and Data line 3N is pre-charged; then SW2 is off and SW3 is on, through the coupling effect of the capacitor CAP2, the gate voltage of TFT B2 is further raised and data line 3N+1 is charged to a preset voltage, and the data line 3N+2 is pre-charged simultaneously. At this point, TFT A3 is turned on and TFT A2 is turned off. As such, the cycle is complete.

Refer to the timing sequence of DEMUX circuit. The DEMUX circuit of the present invention can be used to connect to the RGB display panel to output RGB data signals. The data bus uses every four periods as a cycle, and stays vacant for a period after continuously outputs RGB data signals. At this point, the four periods form a cycle for the corresponding gate line of the display panel, wherein the gate line stays in an on state during three periods and off state in one period. For the switch signals SW1-SW4, four periods form a cycle, wherein each switch signal stays on during one period, and stays off during the other three periods.

Figure 5:
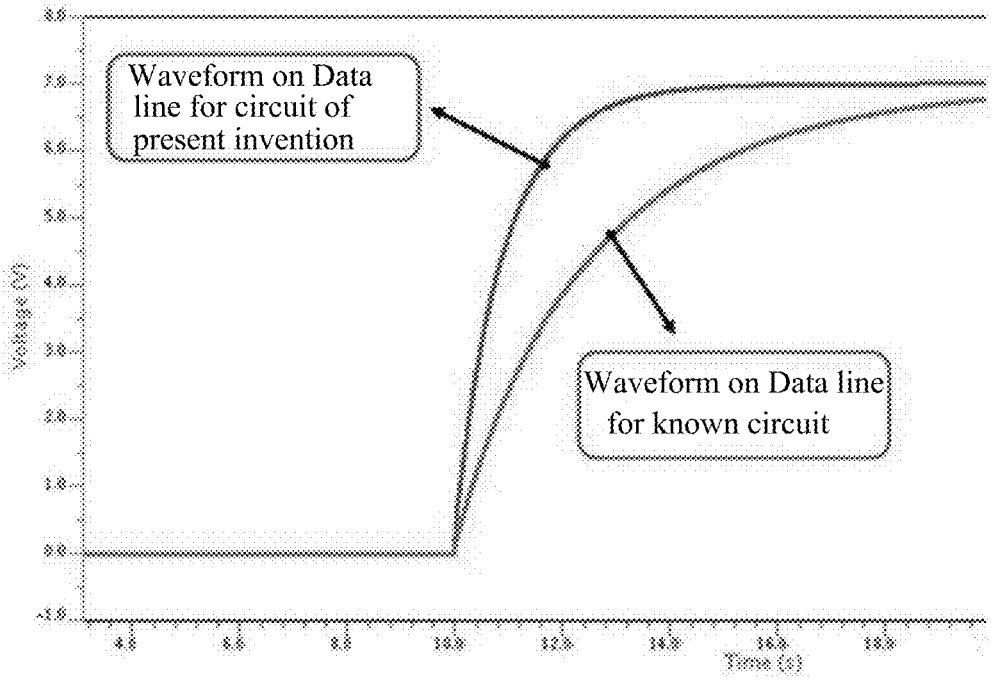
FIG. 5 is a schematic view showing the comparison of the charging waveform of the known DEMUX circuit and the DEMUX circuit according to the present invention.

FIG. 5 shows the comparison of the charging waveform of the known DEMUX circuit and the DEMUX circuit according to the present invention, with x-axis as time (unit: sec) and y-axis as voltage (unit: volt). As shown in FIG. 5, the charging rate is greatly improved with the DEMUX circuit of the present invention.

In summary, the DEMUX circuit of the present invention can increase the driving voltage of the TFT gate, leading to improving the TFT electron mobility from IGZO process and a-Si process, and improving the data line charging rate.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A demultiplexer (DEMUX) circuit, comprising:

a data bus, a first data line, a second data line and a third data line, connected respectively to the data bus and a first unit, a second unit and a third unit respectively corresponding to the first, second and third data lines;

each unit respectively comprising: a first thin film transistor (TFT), a second TFT, a third TFT, and a capacitor, and inputting corresponding a first, a second, and a third switch signals; the first TFT having a gate inputting the first switch signal, and a source and a drain irrespectively inputting to the first switch signal and connected to a gate of the second TFT; the second TFT having a source and a drain respectively connected to the data bus and the corresponding data line; the capacitor having one end connected to the gate of the second TFT and the other connected to the second switch signal; the third TFT having a gate inputting the third switch signal, a source and a drain respectively connected to the gate of the second TFT and a constant low voltage;

for each unit, during operation, when the first switch signal being turned on, the first TFT and the second TFT being turned on, and the corresponding data line is pre-charged; when the first switch signal being turned off, the second switch signal being turned on and the corresponding data line being charged to a preset voltage;

wherein four switch signals are used for inputting to the first, second and third units, each unit selects three switch signals out of the four to use as the first, second and third switch signals corresponding to the unit, and the four switch signals are square waveform having a duty cycle of 0.25, with a phase difference of ¼ cycle among one another.

2. The DEMUX circuit as claimed in claim 1, wherein during operation, by controlling timing of the switch signals corresponding to each unit, when the first unit charges the first data line to a preset voltage, the second unit simultaneously pre-charges the second data line; when the second unit charges the second data line to a preset voltage, the third unit simultaneously pre-charges the third data line; when the third unit charges the third data line to a preset voltage, the first unit simultaneously pre-charges the first data line.

3. The DEMUX circuit as claimed in claim 1, wherein the DEMUX circuit is for indium gallium zinc oxide (IGZO) process.

4. The DEMUX circuit as claimed in claim 1, wherein the DEMUX circuit is for amorphous silicon (a-Si) process.

5. The DEMUX circuit as claimed in claim 1, wherein the DEMUX circuit is connected to an RGB display panel for outputting RGB data signals.

6. The DEMUX circuit as claimed in claim 5, wherein the data bus uses every four periods as a cycle, and after continuously outputs RGB data signals, the data bus stays vacant for a period.

7. A demultiplexer (DEMUX) circuit, comprising:

a data bus, a first data line, a second data line and a third data line, connected respectively to the data bus and a first unit, a second unit and a third unit respectively corresponding to the first, second and third data lines;

each unit respectively comprising: a first thin film transistor (TFT), a second TFT, a third TFT, and a capacitor, and inputting corresponding a first, a second, and a third switch signals; the first TFT having a gate inputting the first switch signal, and a source and a drain irrespectively inputting to the first switch signal and connected to a gate of the second TFT; the second TFT having a source and a drain respectively connected to the data bus and the corresponding data line; the capacitor having one end connected to the gate of the second TFT and the other connected to the second switch signal; the third TFT having a gate inputting the third switch signal, a source and a drain respectively connected to the gate of the second TFT and a constant low voltage;

for each unit, during operation, when the first switch signal being turned on, the first TFT and the second TFT being turned on, and the corresponding data line is pre-charged; when the first switch signal being turned off, the second switch signal being turned on and the corresponding data line being charged to a preset voltage;

wherein four switch signals being used for inputting to the first, second and third units, each unit selecting three switch signals out of the four to use as the first, second and third switch signals corresponding to the unit;

wherein the DEMUX circuit being connected to an RGB display panel for outputting RGB data signals, the four switch signals are square waveform having a duty cycle of 0.25, with a phase difference of ¼ cycle among one another.

8. The DEMUX circuit as claimed in claim 7, wherein during operation, by controlling timing of the switch signals corresponding to each unit, when the first unit charges the first data line to a preset voltage, the second unit simultaneously pre-charges the second data line; when the second unit charges the second data line to a preset voltage, the third unit simultaneously pre-charges the third data line; when the third unit charges the third data line to a preset voltage, the first unit simultaneously pre-charges the first data line.

9. The DEMUX circuit as claimed in claim 7, wherein the DEMUX circuit is for indium gallium zinc oxide (IGZO) process.

10. The DEMUX circuit as claimed in claim 7, wherein the DEMUX circuit is for amorphous silicon (a-Si) process.

11. The DEMUX circuit as claimed in claim 7, wherein the data bus uses every four periods as a cycle, and after continuously outputs RGB data signals, the data bus stays vacant for a period.

* * * * *